US007395843B1

(12) United States Patent
Brand

(10) Patent No.: US 7,395,843 B1
(45) Date of Patent: Jul. 8, 2008

(54) METHOD AND APPARATUS FOR RETAINING A FLITCH FOR CUTTING

(75) Inventor: Robert D. Brand, Lawrence, IN (US)

(73) Assignee: Indiana Forge, LLC, Westfield, IN (US)

( * ) Notice: Subject to any disclaimer, the term of this patent is extended or adjusted under 35 U.S.C. 154(b) by 485 days.

(21) Appl. No.: 09/377,120

(22) Filed: Aug. 19, 1999

Related U.S. Application Data

(63) Continuation of application No. 09/245,954, filed on Feb. 5, 1999, now abandoned, which is a continuation of application No. 08/752,800, filed on Nov. 20, 1996, now Pat. No. 5,868,187, which is a continuation-in-part of application No. 08/685,207, filed on Jul. 23, 1996, now Pat. No. 5,701,938, which is a continuation of application No. 08/455,479, filed on May 31, 1995, now Pat. No. 5,562,137.

(51) Int. Cl.
*B27L 5/00* (2006.01)

(52) U.S. Cl. ..... 144/178; 144/214

(58) Field of Classification Search ..... 144/179, 144/209.1–215
See application file for complete search history.

(56) References Cited

U.S. PATENT DOCUMENTS

| | | | | |
|---|---|---|---|---|
| 793,306 | A | 6/1905 | Koss | |
| 2,576,520 | A | 11/1951 | Koss | 144/178 |
| 2,676,627 | A | 4/1954 | McFall | 144/178 |
| 3,441,069 | A | 4/1969 | Koss | 144/309 |
| 3,654,973 | A | 4/1972 | Koss | 144/178 |
| 3,680,612 | A | 8/1972 | Hale | 144/178 |
| 3,808,925 | A | 5/1974 | Hards | 83/346 |
| 3,905,408 | A | 9/1975 | Hale | 144/178 |
| 4,068,693 | A | 1/1978 | Cremona | 144/178 |
| 4,069,850 | A | 1/1978 | Cremona | 144/178 |
| 4,352,488 | A | 10/1982 | Cremona | 269/54.2 |
| 4,392,519 | A | 7/1983 | Calvert | 144/212 |
| 4,503,896 | A | 3/1985 | Brand | 144/369 |
| 4,587,616 | A | 5/1986 | Weil | 364/475 |
| 4,601,317 | A | 7/1986 | Brand | 144/178 |
| 4,683,926 | A | 8/1987 | Weil | 144/178 |
| 5,101,874 | A | 4/1992 | Weil | 144/209 |
| 5,143,129 | A | 9/1992 | Toivio | 144/211 |

(Continued)

FOREIGN PATENT DOCUMENTS

| | | | |
|---|---|---|---|
| EP | 0627285 | A2 | 7/1994 |

(Continued)

*Primary Examiner*—Shelley Self
(74) *Attorney, Agent, or Firm*—Brinks Hofer Gilson & Lione

(57) ABSTRACT

Method and apparatus for retaining a tapered flitch having a veneer-producing zone on a flitch table for rotating or translational movement past a veneer-slicing knife comprises stationary dog means coupled to a flitch-carrying body for engaging the flitch and means for engaging the flitch with the stationary dog means to hold the flitch on the flitch-carrying body. The flitch-carrying body may be part of a modular flitch table assembly. In the invention, the flitch is held on the flitch table with the veneer-producing zone in a parallel relation with the veneer-slicing knife so as to minimize the amount of waste veneer taken from the veneer-producing zone.

11 Claims, 13 Drawing Sheets

U.S. PATENT DOCUMENTS

| | | | | | |
|---|---|---|---|---|---|
| 5,150,746 | A | * | 9/1992 | Weil | 144/177 X |
| 5,333,658 | A | | 8/1994 | Albion et al. | 144/213 |
| 5,385,184 | A | | 1/1995 | Mellor | 144/178 |
| 5,865,232 | A | | 2/1999 | Miller et al. | 144/363 |

FOREIGN PATENT DOCUMENTS

| | | |
|---|---|---|
| JP | 63-61165 | 3/1980 |

* cited by examiner

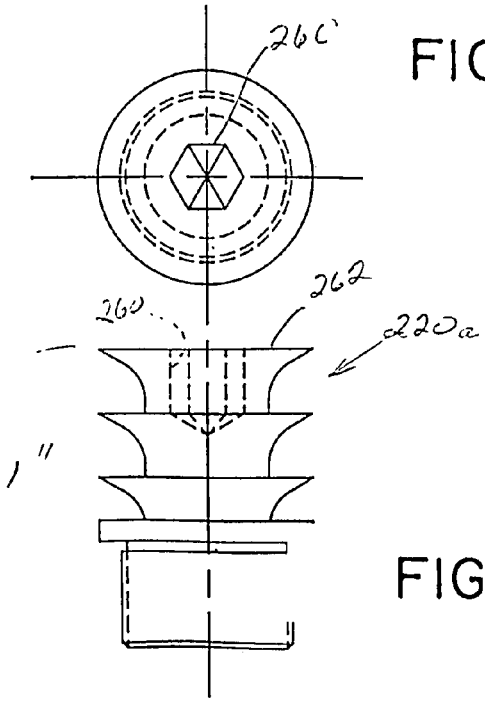
FIG. 18A
FIG. 18B
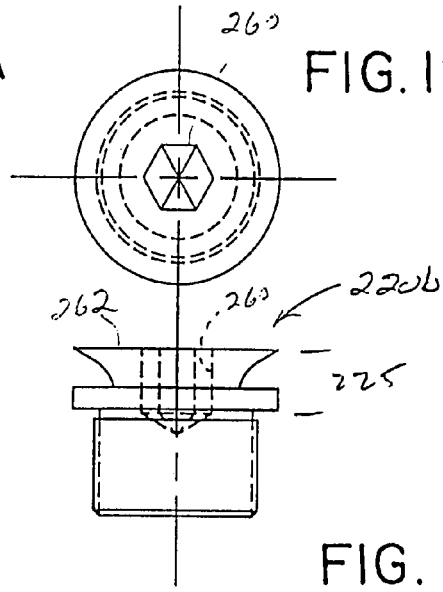
FIG. 19A
FIG. 19B
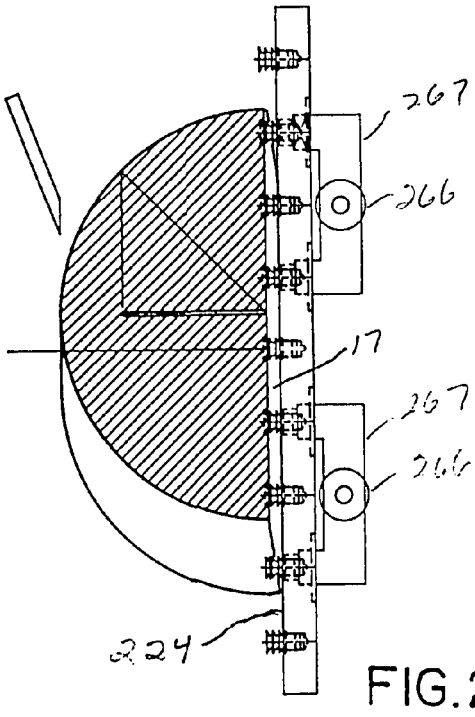
FIG. 23
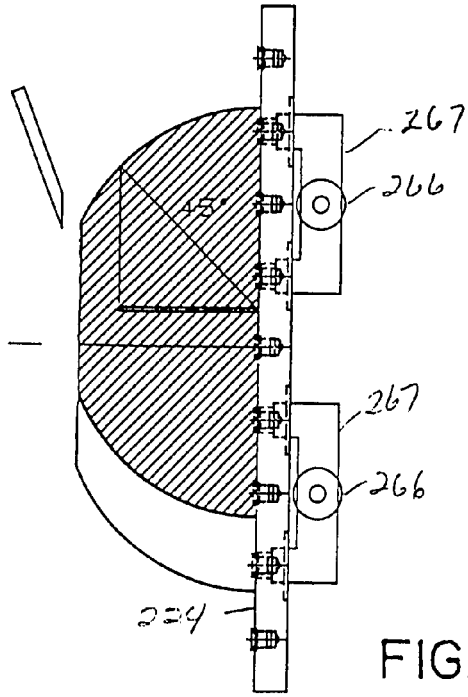
FIG. 24

METHOD AND APPARATUS FOR RETAINING A FLITCH FOR CUTTING

This application is a continuation of application number 09/245,954, filed Feb. 5, 1999, now abandoned, which is a continuation of patent application Ser. No. 08/752,800 filed Nov. 20, 1996, now U.S. Pat. No. 5,868,187, which is a continuation-in-part of prior patent application Ser. No. 08/685,207 filed Jul. 23, 1996, now U.S. Pat. No. 5,701,938, which is a continuation of prior patent application Ser. No. 08/455,479 filed May 31, 1995, now U.S. Pat. No. 5,562,137.

FIELD OF THE INVENTION

The present invention relates to veneer slicers having a flitch table for moving a flitch past a knife, and particularly to the means for retaining the flitch on the flitch table so as to produce a backing board having a minimum thickness and thereby maximizing the amount of veneer produced from the flitch.

BACKGROUND OF THE INVENTION

Reciprocating flitch tables for use with veneer slicers are known. Such flitch tables hold a flitch and move relative to a slicing knife. As the flitch passes the knife, the knife slices a sheet of veneer from the flitch.

Conventional flitch tables use a plurality of dogs to hold the flitch in position against a mounting surface of the flitch table. The dogs are clamping members that extend from the mounting surface of the flitch table and are positioned on either side of the flitch along the flitch table. Typically, the dogs include a sharp-edged portion oriented parallel to the mounting surface of the flitch table to cut into the flitch and hold it in place against the flitch table. The dogs are moved toward each other to pinch the flitch therebetween.

An alternative dogging arrangement is disclosed in U.S. Pat. No. 5,150,746 to Weil. Weil discloses a plurality of oval-shaped rotating dogs that include a sharp-edged portion at the ends of the major axis of the oval. The dogs are arranged in parallel rows along the mounting surface of the flitch table. A plurality of axially extending grooves are cut into the mounting surface of the flitch. The grooves are cut to align with the rows of dogs and are sized to allow the dogs to fit up into the grooves when the major axis of the oval is aligned with the groove. When the flitch is mounted on the flitch table, the oval-shaped dogs extend upwardly into the grooves and are rotated to engage the sharp-edged portion of the dogs with the flitch.

Regardless of whether clamping dogs or rotating dogs are used, conventional flitch mounting techniques require that the flitch mounting surface be positioned adjacent the flitch table mounting surface. Unfortunately, these conventional mounting techniques cause some veneer on a log to be wasted. In particular, conventional dogs extend about ⅝ inch from the mounting surface of the flitch table. In order to avoid contact between the slicing knife and the dogs, the slicer must stop slicing as the knife approaches the dogs, thereby leaving a considerable amount of veneer as waste on the backing board. Also, the grooves cut in the flitch to receive the dogs remove enough wood from the flitch so as to provide a weakened area that allows the flitch to flex under pressure from the knife. The flexing of the flitch produces shim sheets that are unusable and hence waste.

When a flitch is to be sliced on a reciprocating slicer, it is typically squared off to remove most, if not all, of the natural taper of the log. The flitch is then cut down the middle along its longitudinal axis so that the plane formed by the cut defines a flitch mounting surface. Typically, the flitch is mounted with the flitch mounting surface positioned adjacent the flitch table and held in place by conventional dogs. Of course, as the veneer is sliced from the flitch, the thickness of the flitch is reduced until the dogs approach the plane of travel of the knife. In addition, the grooves cut in the flitch mounting surface result in shim sheets, thereby placing another limit on how much veneer can be removed from the flitch. Thus, there is a limit to how much veneer can be removed from a flitch in order to avoid contact between the knife and the dogs and/or to avoid shim sheets. In conventional flitch tables, the remaining flitch, or backing board, is typically on the order of 1 to 1½ inches thick. If the remaining thickness of the backing board can be reduced, a veneer producer can achieve greater productivity from the same flitch.

When a flitch is to be sliced on a rotary veneer slicer, it is typically cut in half along the longitudinal axis of the flitch and the naturally occurring taper is retained. The plane of the cut forms the flitch mounting surface which is positioned against the mounting surface of a rotary staylog. Because the tree trunk is naturally tapered, one end of the flitch is thicker than the other end, and consequently extends a greater distance from the mounting surface of the staylog. As a result, the veneer-producing zone of the flitch is frusto-conical, i.e., trapezoidal in cross-section when viewed from the side of the flitch or from the knife. As the staylog and the flitch are rotated in a rotary veneer slicer, the knife first encounters the thickest portion of the flitch. With each rotation, the knife slices a wider veneer sheet until the entire length of the flitch is exposed to the knife. Once the entire length of the flitch is being sliced, subsequent sheets are of substantially uniform width. However, the initial sheets, which are cut from the best part of the log, are too narrow to be useful, and are thrown away as wasted product. Consequently, some of the best veneer on a flitch is thrown away as waste. In addition, with the prior art methods of retention, the grooves formed along the length of the flitch remove sufficient material from the flitch that the flitch loses its rigidity and flexes in response to the pressure of the slicing knife resulting in, at best, nonuniform and unacceptable slices of veneer.

A tapered flitch can also be sliced on a reciprocating flitch table, but the same problem exists. That is, the taper of the flitch will prevent the first sheets sliced from the flitch from being used, even though the first sheets come from the best portion of the flitch. Moreover, the grooves cut in the flitch to receive the dogs result in a weakened area that allows the flitch to flex under pressure of the knife. Regardless of whether the flitch is sliced on a rotary or reciprocating slicer, the flitch would preferably be sliced so as to maximize the amount of veneer, and minimize waste, taken from the desirable veneer-producing zone of the flitch.

SUMMARY OF THE INVENTION

According to the present invention, an apparatus for retaining a tapered flitch having a veneer-producing zone on a flitch table for movement past a veneer-slicing knife comprises stationary dog means coupled to the flitch table for engaging the flitch and means for moving the flitch into engagement with the stationary dog means to hold the flitch on the flitch table. The flitch is held on the flitch table with the veneer-producing zone in a parallel relation with the veneer-slicing knife so as to minimize the amount of waste veneer taken from the veneer-producing zone.

The stationary dog means includes a plurality of stationary dogs extending orthogonally from the flitch table. Each stationary dog includes at least one annular knife edge for engaging a flitch and means for adjusting the orthogonal extension of the stationary dog relative to the flitch table.

The flitch includes a plurality of dog-receiving holes formed in a flitch mounting surface. Each dog-receiving hole extends into the flitch to a predetermined depth which defines a boundary of the veneer-producing zone. Since the veneer-producing zone is maintained parallel to the veneer-slicing knife, the predetermined depth is greater at the thicker end of the flitch and smaller at the thinner end of the flitch, thereby automatically accounting for the amount of taper in the flitch.

The flitch table includes a longitudinal axis, an axially extending channel and a pusher bar movably disposed in the channel for axial movement therein. The means for moving includes driving means for axially moving the pusher bar in the channel and at least one pusher pin is coupled to the pusher bar for movement therewith. The pusher pin extends orthogonally from the pusher bar and includes means for adjusting the orthogonal extension of the pusher pin from the pusher bar.

The driving means includes at least one piston and cylinder assembly coupled to the pusher bar for moving the flitch into engagement with the stationary dog means. The driving means can include a second piston and cylinder assembly coupled to the pusher bar for moving the flitch out of engagement with the stationary dog means. Push pin means is coupled to the flitch table for moving the flitch into engagement with the stationary dog means so that the stationary dog means holds the flitch on the flitch table. The push pin means includes a plurality of pusher pins, coupled to the flitch table, for engaging the flitch.

The invention further includes a method of retaining a flitch on a flitch table for slicing veneer from the flitch, wherein the flitch table includes a plurality of stationary pin dogs. The method comprises the steps of providing a flitch having a first plurality of holes for receiving a plurality of stationary pin dogs, positioning the plurality of stationary pin dogs in the first plurality of holes, and moving the flitch into engagement with the stationary pin dogs to retain the flitch on the flitch table.

The moving step includes the step of providing a plurality of pusher pins, wherein the flitch includes a second plurality of holes for receiving the plurality of pusher pins. The moving step further includes the step of providing means for moving the pusher pins to move the flitch into engagement with the stationary dogs.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

FIGS. 18*a*-18*b* illustrate a pin dog for use with the flitch table of FIG. 14;

FIGS. 19*a*-19*b* illustrate an alternative embodiment of a pin dog for use with the flitch table of FIG. 14.

FIG. 23 is an end view of a flitch table incorporating the tall pin dogs of FIGS. 18*a*-18*b* to retain a tapered flitch; and FIG. 24 is an end view of a flitch table incorporating the short pin dogs of FIGS. 19*a*-19*b*.

DETAILED DESCRIPTION OF THE DRAWINGS

Apparatus for retaining a flitch 13 on a staylog 10 includes stationary dog means coupled to the staylog 10 for engaging the flitch 13 and pushing means for moving the flitch 13 into engagement with the stationary dog means. The stationary dog means preferably includes stationary dogs (e.g., 54 of FIGS. 1-4) that further include a plurality of flitch engagement surfaces (e.g., 80). The pushing means preferably includes a plurality of pusher pins (e.g., 56 of FIGS. 1-4) coupled to the staylog 10. The plurality of pusher pins move the flitch 13 into engagement with the flitch engagement surfaces of the stationary dogs which bite into the flitch 13 to retain the flitch 13 on the staylog.

A method of retaining a flitch 13 on a mounting surface 18 of a staylog 10 comprises the steps of providing the mounting surface 18 with a plurality of stationary flitch-engaging surfaces, providing the flitch 13 with a plurality of engagement surfaces adapted for engagement with the plurality of stationary flitch-engaging surfaces, placing the flitch 13 on the staylog 10 with its engagement surfaces adjacent the plurality of stationary flitch-engaging surfaces, and moving the flitch 13 relative to the staylog 10 for engagement of the flitch-engaging surfaces of the staylog 10 with the engagement surfaces of the flitch 13 and retention of the flitch 13 on the staylog 10.

Figure 1:
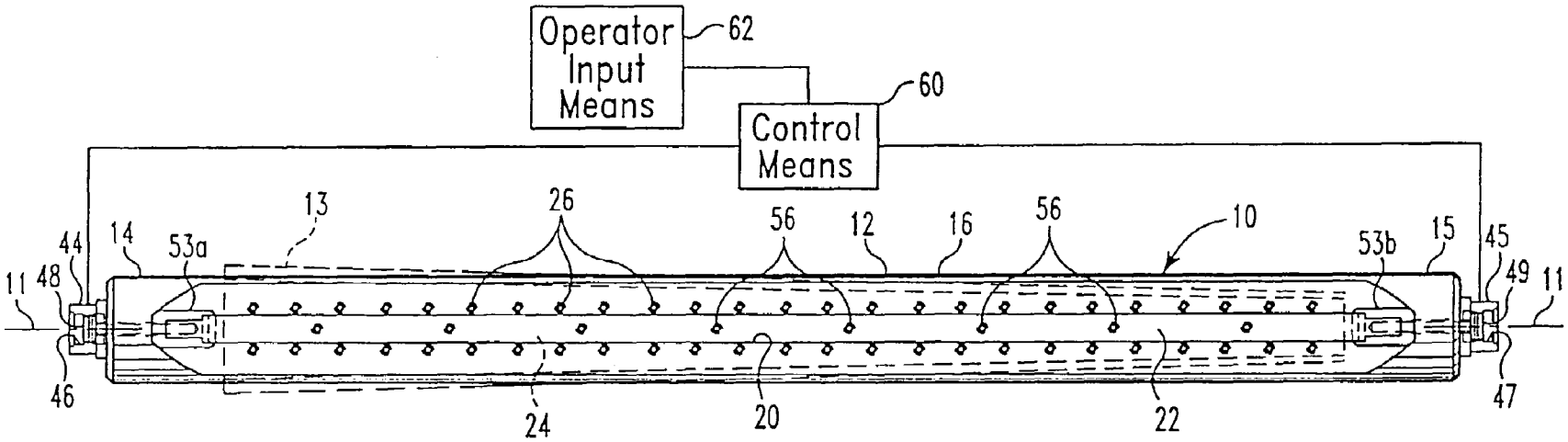
FIG. 1 is a top plan view of a rotary staylog according to the present invention with a flitch (in dotted lines) mounted thereon.
Figure 2:
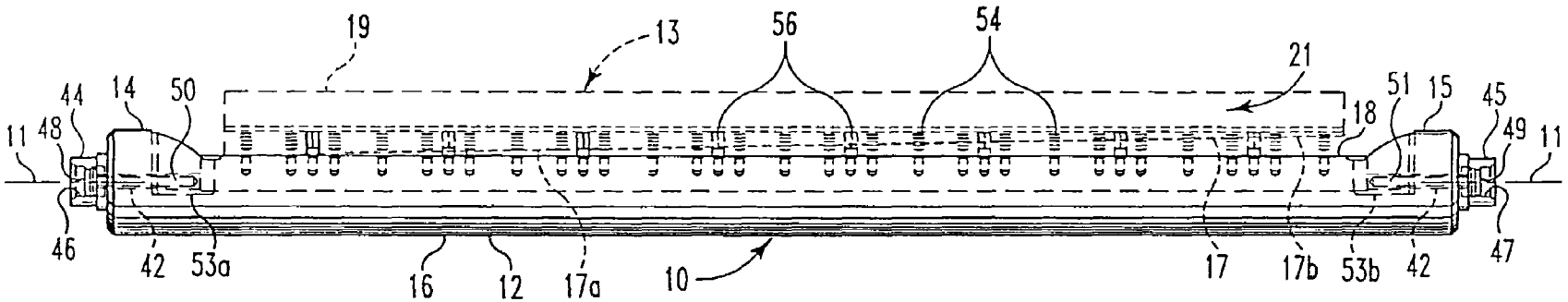
FIG. 2 is a side elevation of the staylog and flitch of FIG. 1.
Figure 5:
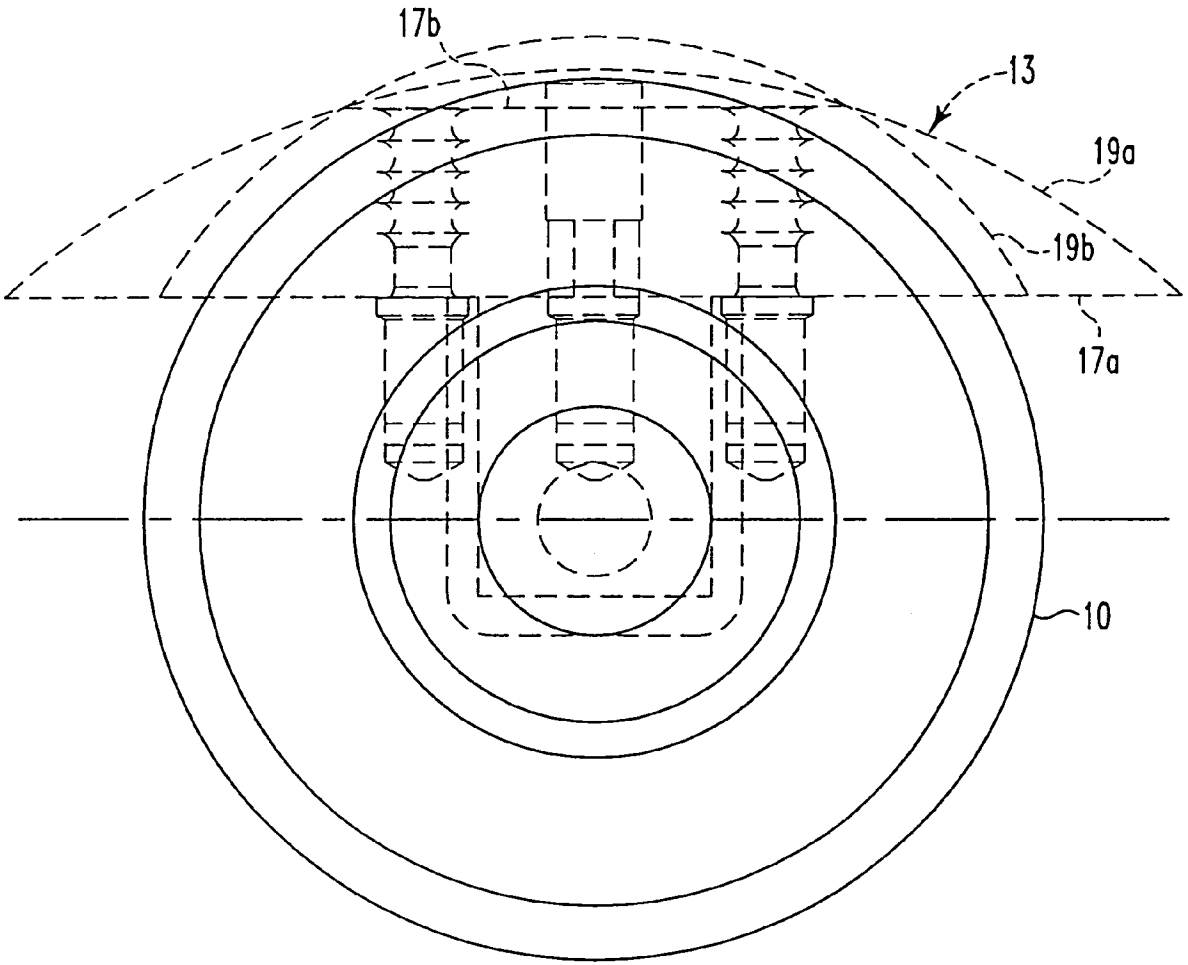
FIG. 5 is an enlarged end view of the staylog of FIG. 1.
Figure 8A:
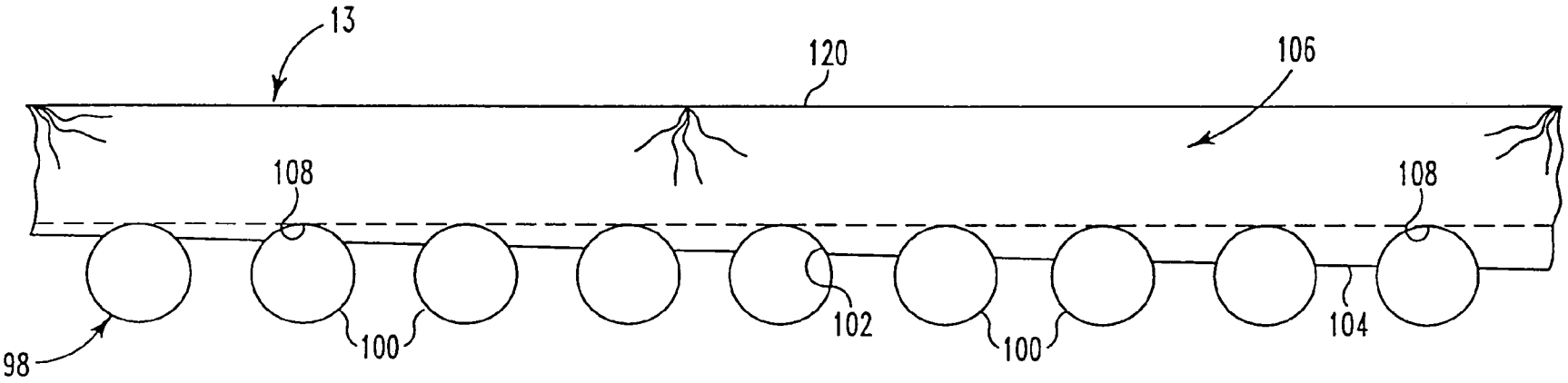
FIGS. 8*a*-8*b* show illustrative positions and depths of plunge cuts made by a dado saw.
Figure 8B:
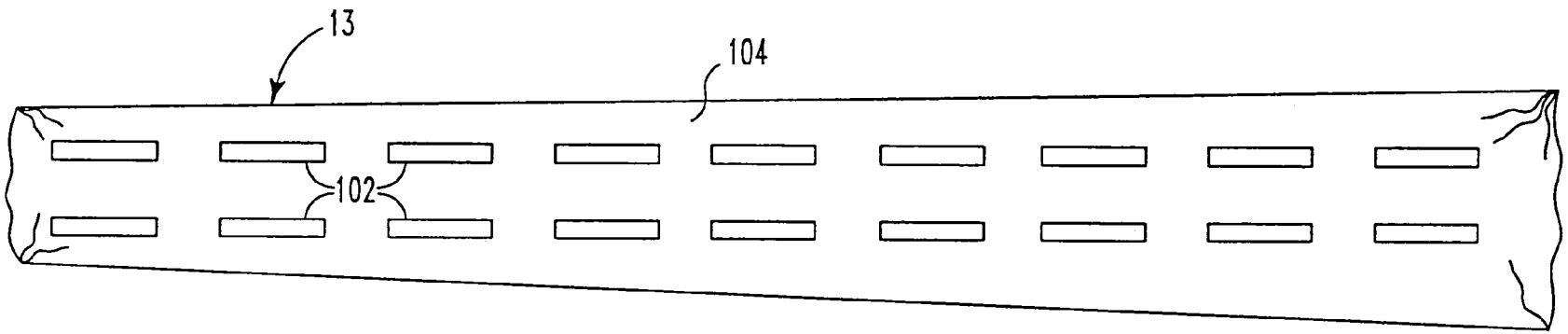

A rotary staylog 10 can include a cast cylinder 12 that defines end portions 14, 15 and a central portion 16 extending therebetween. As shown in FIGS. 1-2, a flitch 13 is mounted to the staylog 10 between the end portions 14, 15 and includes a mounting surface 17 and an outer veneer-producing surface 19. As shown in FIG. 5, the flitch mounting surface 17 extends from the wide end 17*a* at the thick end of the flitch 13 to the narrow end 17*b* at the thin end of the flitch 13.

The central portion 16 of the staylog 10 is milled to include a flat mounting surface 18 formed by a pair of mounting rails 16*a* and 16*b* defining an axial channel 20 therebetween extending along the longitudinal axis 11 of the cylinder 12. A pusher bar 22 is slidably disposed in the channel 20 and extends substantially along the length of the channel 20, the pusher bar 22 being several inches shorter than the channel 20 in order to allow for axial movement of the pusher bar 22 in the channel 20. The pusher bar 22 is sized to extend upwardly in the channel 20 so that the top surface 24 of the pusher bar 22 is substantially coplaner with, and forms part of, the mounting surface 18.

Figure 3:
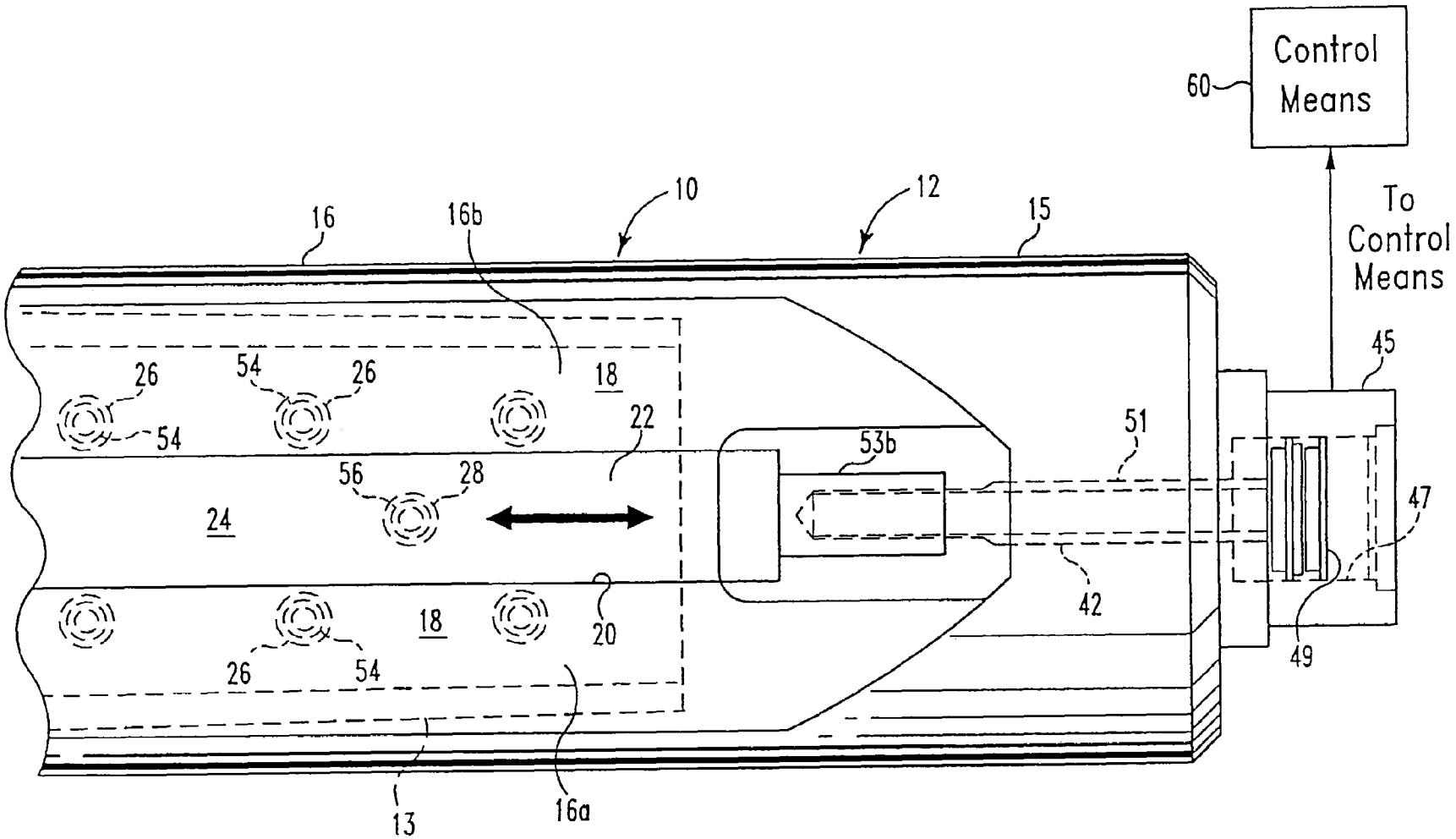
FIG. 3 is an enlarged top plan view of one end of the staylog and flitch of FIG. 1.
Figure 6:
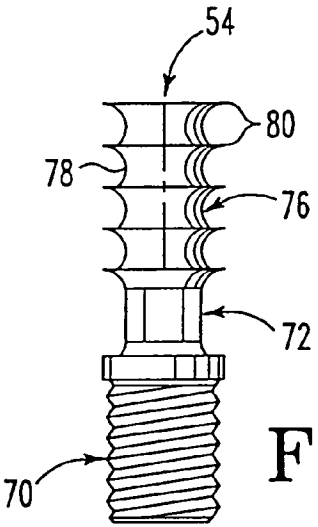
FIG. 6 is a side view of a stationary pin dog according to the present invention.

The mounting surface 18 includes a plurality of threaded pin dog apertures 26. The threaded apertures 26 are arranged in pairs along the length of the central portion 16, with the apertures of each pair disposed on opposite sides of the channel 20, as shown in FIGS. 1 and 3. A pin dog 54, shown more clearly in FIG. 6, is threaded into each pin dog aperture 26 to provide a plurality of stationary pin dogs extending orthogonally from the mounting surface 18.

Figure 7:
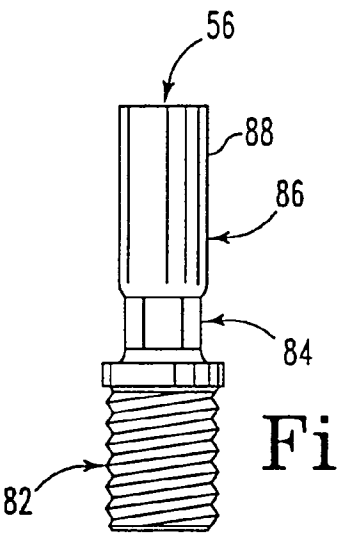
FIG. 7 is a side view of a pusher pin according to the present invention.

The top surface 24 of the pusher bar 22 includes a plurality of threaded pusher pin apertures 28 arranged in spaced-apart relation along the length of the pusher bar 22. A pusher pin 56, shown more clearly in FIG. 7, is threaded into each pusher pin aperture 28. A preferred arrangement of pin dogs 54 and pusher pins 56 is shown in FIGS. 1, 3 and 5 but other arrangements can be used without departing from the scope of the invention.

The end portions 14, 15 of the staylog 10 are essentially mirror images of each other, and include a central bore 42 that extends coaxially along the longitudinal axis 11 of the cylinder 12 and opens into the central channel 20. Piston housings 44, 45 are attached to the end portions 14, 15, respectively, and form cylinders 46, 47 which enclose drive pistons 48, 49, respectively. The pistons 48, 49 are positioned for movement along the axis 11. Pusher blocks 53*a*, 53*b* are disposed in the central bore 42 adjacent each end of the pusher bar 22. Piston rods 50, 51 are attached to the pistons 48, 49, respectively, and extend into the bore 42 to abut the pusher blocks 53*a*, 53*b*, respectively.

The pistons 48, 49 are controlled in a conventional manner by control means 60 which directs the flow of operating fluid from a reservoir (not shown) to one of the pistons 48, 49 and simultaneously permits a return flow of operating fluid from the other piston 49, 48 to the reservoir. Thus, application of operating fluid to piston 48 extends the piston rod 50 to drive the pusher block 53*a* and pusher bar 22 to the right. At the same time, operating fluid is vented from piston 49 back to the reservoir to prevent piston 49 from blocking movement of the pusher bar 22 to the right. Application of operating fluid to piston 49 extends the piston rod 51 to drive the pusher block 53*b* and pusher bar 22 to the left. At the same time, operating fluid is vented from piston 48 back to the reservoir to prevent piston 48 from blocking movement of the pusher bar 22 to the left. It will be appreciated that a single piston and piston rod can be attached directly to the pusher bar 22 to move the pusher bar 22 in both directions. In that case, the operating fluid would be directed to opposite sides of the piston.

The control means 60 includes control valves and actuating means connected as necessary to direct the operating fluid to the pistons 48, 49 and return the fluid to the reservoir. Operator input means 62 controls the flow of operating fluid by directing the control means 60 to direct operating fluid to piston 48 to drive the pusher bar 22 to the right or direct operating fluid to piston 49 to drive the pusher bar 22 to the left. Operator input means 62 can include actuating levers, push buttons or the like to indicate a desired direction of pusher bar movement.

Preferred pin dogs 54 (FIG. 6) extend a greater distance from the mounting surface 18 than conventional dogs and include a lower threaded portion 70, a central polygon-shaped portion 72, and an upper flitch-engaging portion 76. The lower threaded portion 70 includes external threads for threadedly engaging the pin dog apertures 26. When used in conjunction with shims or washers, the lower threaded portion 70 also provides means for adjusting the orthogonal extension of the pin dogs relative to the mounting surface 18. The central polygon-shaped portion 72 is preferably hexagonal for engaging a wrench (not shown) for screwing the pin dog 54 into the pin dog aperture 26. The upper flitch-engaging portion 76 includes a scalloped side wall 78 defining a plurality of annular knife edges 80 for engaging a flitch 13. The annular knife edges 80 are axially spaced along the pin dogs 54 so as to be positioned at various distances from the staylog 10.

Preferred pusher pins 56 include a lower threaded portion 82, a central polygon-shaped portion 84, and an upper flitch-engaging portion 86. The lower threaded portion 82 and the central polygon-shaped portion 84 are substantially similar in design and identical in function to their counterparts 70, 72, respectively, on the pin dogs 54. The upper portion 86 includes a cylindrical side wall 88 for moving the flitch 13.

The description that follows relates to the invention as it may be incorporated into a rotary veneer slicer, although it will be clear to those skilled in the art that the invention can also be incorporated into veneer slicers that remove veneer from a flitch with non-rotary motion.

A flitch includes, generally, a conical portion corresponding to the base of the tree from which it was taken, and veneer taken from this portion of the flitch is frequently of the highest quality. As the flitch is normally mounted to the staylog, its outer surface and veneer-producing zone are not parallel to the slicing knife so that upon rotation of the staylog, only narrow waste sliced veneer is produced from the thicker end of the flitch.

Figure 4:
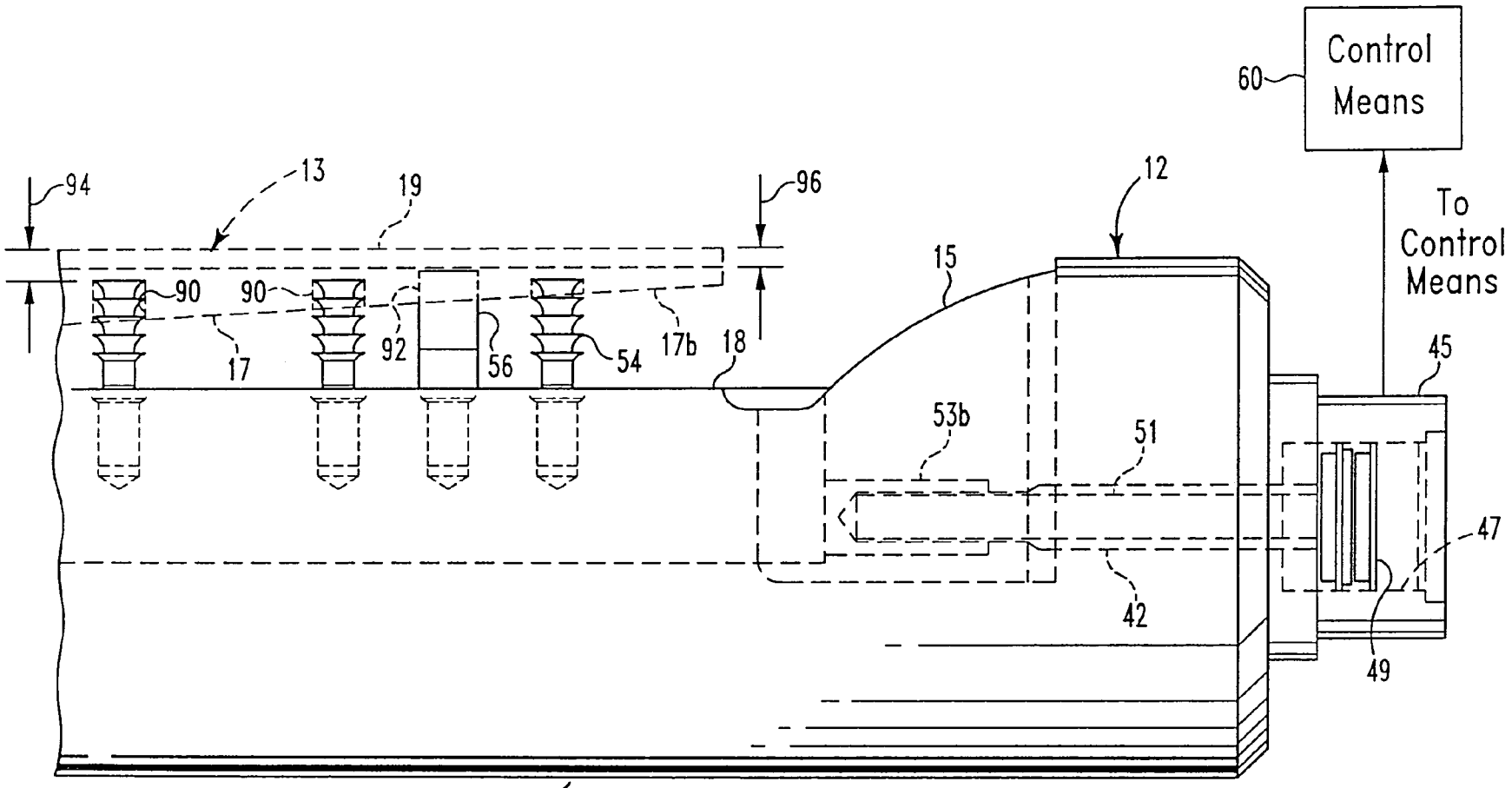
FIG. 4 is an enlarged side elevation of the end of the staylog and flitch of FIG. 3.

In the invention, however, the flitch is retained on the staylog so its outermost surface is substantially parallel to the slicing knife, thus providing a veneer-producing zone, which is generally a cylindrical segment, most generally a semi-cylindrical portion, arranged with an axis of rotation parallel to the mounting surface and axis of rotation of the staylog. For example, the flitch 13 can be prepared for slicing by boring holes in the mounting surface 17 for receiving, and providing engagement surfaces for, the pin dogs 54 and the pusher pins 56. As shown in FIG. 4, a first plurality of pin dog-receiving holes 90 are sized to fit and positioned to engage the pin dogs 54, and a second plurality of pusher pin-receiving holes 92 are sized to fit and positioned to engage the pusher pins 56. The pin dog-receiving holes 90 are formed to extend a predetermined distance from the mounting surface 18 of the staylog 10 into the flitch 13 so that all of the holes 90 terminate at a first distance 94 from the outermost veneer-producing surface 19, thereby forming a veneer-producing zone 21, best illustrated in FIG. 4. Thus, the holes 90 at the thicker end of the tapered flitch are deeper than the holes 90 at the thinner end of the flitch. Likewise, the pusher pin-receiving holes 92 terminate at a second distance 96 from the veneer-producing surface 19, wherein the first distance 94 can be equal to the second distance 96. The primary factors in determining the first and second distances 94, 96 is maximizing the depth of the veneer-producing zone 21 while affording maximum surface contact between the pusher pins 56 and the pusher pin-receiving holes 92 as well as maximum engaging contact between the pin dogs 54 and the flitch 13.

The flitch 13 is positioned on the staylog 10 with the pin dogs 54 and pusher pins 56 disposed in their respective holes. When positioning the flitch 13 on the staylog 10, the flitch 13 rests against the tops of the pin dogs and is thereby aligned so that its outermost surface and the veneer-producing zone 21 are parallel to the mounting surface 18 of the staylog 10.

When a tapered flitch is to be sliced with a rotary veneer slicer, as shown in FIG. 4, due to the taper of the flitch 13, the mounting surface 17 of the flitch 13 will generally be positioned at an angle to the mounting surface 18 of the staylog 10. Consequently, the holes 90, 92 will have different depths in order to provide a constant-thickness veneer-producing zone 21.

Advantageously, the plurality of annular knife edges 80 on each pin dog 54 allows each pin dog 54 to engage the flitch 13 without regard to the distance between the flitch mounting surface 17 and the staylog mounting surface 18. Moreover, as shown in FIGS. 2 and 4, in those areas where the flitch 13 is thicker, and therefore more massive, more annular knife edges 80 engage the flitch 13 to provide additional holding capability where needed.

Once the flitch 13 is positioned on the staylog, the operator commands the pusher bar 22 to move in a first direction. The movement of the pusher bar 22 causes the pusher pins 56 to move the flitch 13 in the first direction until the engagement surfaces of holes 90 of the flitch 13 engage the annular knife edges 80 on the pin dogs 54. The annular knife edges 80 cut into the engagement surface of flitch 13 and hold the flitch 13 in position. While the use of pusher pins to engage the flitch with the pin dogs is one preferred embodiment of the invention, the flitch may be moved into engagement with stationary pin dogs by other means, such as movable bars or brackets that engage the ends of the flitch.

When the operator is satisfied that the flitch 13 is securely retained on the staylog, the operator adjusts the staylog offset to produce the desired curvature of the veneer-producing surface 19. Staylog offset is the distance between the axis of rotation of the staylog/flitch combination and the longitudinal axis 11 of the staylog 10. As shown in FIG. 5, the curvature can vary between curvatures 19*a* and 19*b*, depending on the staylog offset selected by the operator. With maximum offset, the resulting curvature is indicated at 19*a*. With minimum offset, the resulting curvature is indicated at 19*b*.

If, because of the forces imposed on the flitch as it is sliced, the engagement between the flitch engaging surfaces at the pin dogs 54 and the engagement surfaces of the pin dog receiving holes 90 becomes too loose, the operator can command the pusher bar 22 to move in a second direction opposite to the first direction. The movement of the pusher bar 22 causes the pusher pins 56 to move the flitch 13 in the second direction until the pin dogs 54 engage the flitch at different engagement surfaces of the pin dog receiving holes 90 for completion of the slicing operation. When the slicing operation has been completed, the pusher bar 22 can be positioned so flitch 13 disengages from the annular knife edges 80. Once the flitch 13 is disengaged from the pin dogs 54, it can be removed and replaced with another flitch 13.

It is understood that the pin dog knife edges can be modified to include non-annular knife edges without departing from the scope of the invention. For example, the pin dogs could be provided with diametrically opposed knife edges that can be aligned with the axial movement of the flitch 13 so as to engage the flitch 13 regardless of whether the flitch 13 moves to the right or left. However, annular knife edges are preferred because they provide more flitch-engaging surface area.

Preferred pusher pins 56 do not include knife edges in order to avoid pusher pin engagement with the flitch 13 while disengaging the flitch 13 from the pin dogs 56. If the pusher pins 56 included knife edges, the flitch 13 could remain engaged with the pusher pins, thereby preventing the easy removal of the flitch 13 from the staylog 10.

It will be appreciated that the pin dogs 54 could also be mounted on a conventional staylog and the flitch retained by pushing a movable pin dog toward a stationary pin dog and pinching the flitch 13 therebetween in a conventional fashion. Modifying a conventional staylog, as shown in FIG. 10, to include stationary and movable pin dogs 134, 136 would eliminate the need for pusher pins 56 and pusher pin-receiving holes 92, thereby simplifying flitch preparation while still allowing for multiple knife edges to engage the flitch 13 at various distances from the staylog mounting surface 18.

FIGS. 8-11 illustrate alternative embodiments that can be incorporated into a conventional staylog. As generally indicated in FIGS. 8*a*-8*b*, hole forming means 98, illustratively a dado saw blade 100, can be used to cut dado holes 102 into the flitch mounting surface 104. The dado holes 102 have a generally rectangular opening 106 at the flitch mounting surface 104 (FIG. 8*b*) and a generally circular depth profile 108 (FIG. 8*a*). Dado holes 102 can be formed efficiently by moving a dado saw blade 100 along the flitch mounting surface 104 and plunging the saw blade 100 into the flitch at the desired positions to a desired depth, which would be determined by the thickness of the veneer-producing zone 106. Of course, the dado holes 102 can be formed by using other hole forming means, such as a router, drill, lasers, or the like. It is also possible to vary the shape of the dado holes 102 without departing from the scope of the invention. For example, the hole forming means 98 can be used to bore generally rectangular holes having a flat, rather than circular, depth profile.

Figure 9B:
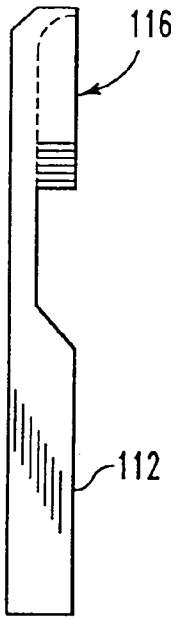
FIGS. 9*a*-9*b* show a dog configured to match a plunge cut of FIGS. 8*a*-8*b;*
Figure 9A:
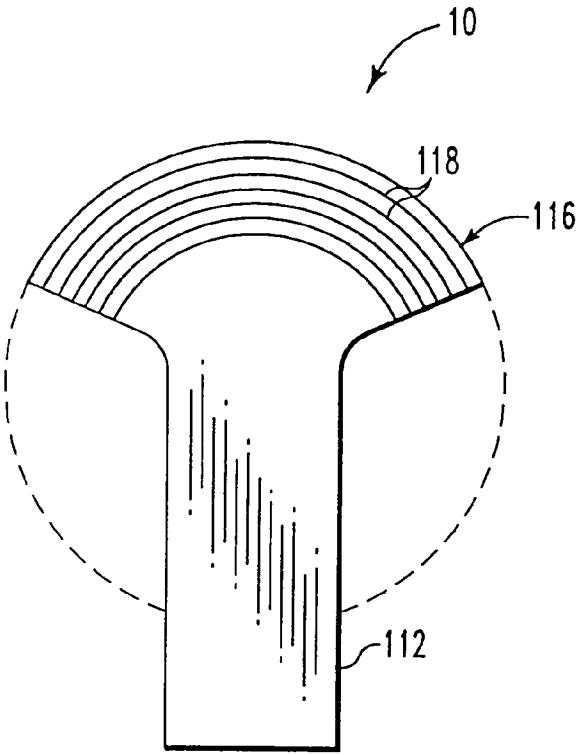
Figure 11A:
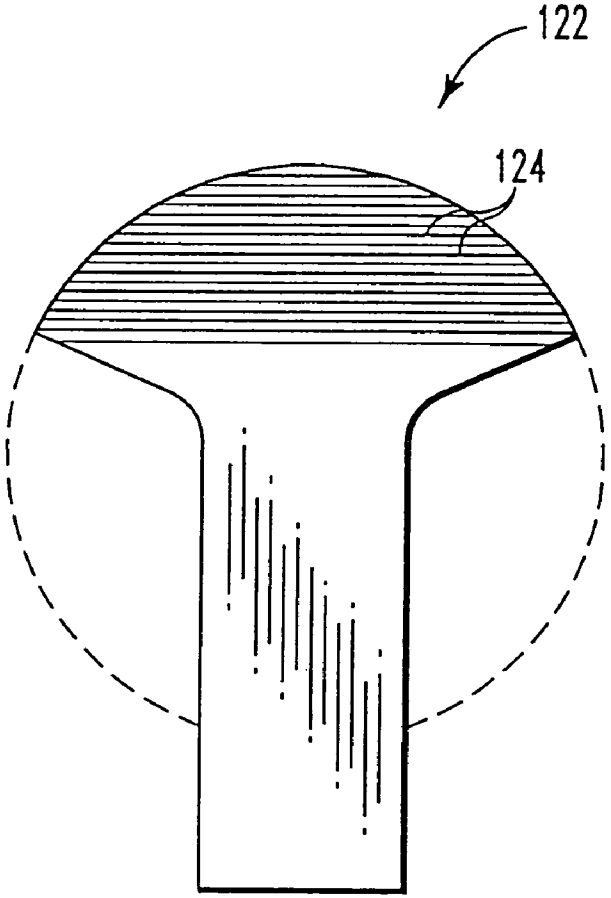
FIGS. 11*a*-11*b* show an alternative embodiment of the dog of FIGS. 9*a*-9*b;*
Figure 11B:
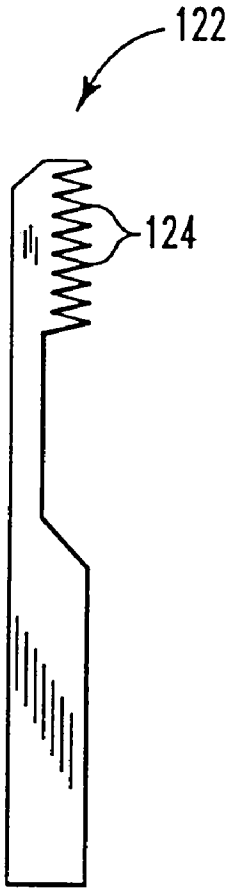

A flitch-retaining dog 110 for use with the dado holes 102 is illustrated in FIGS. 9*a*-9*b*. The dogs 110 include an elongated actuating arm 112 and a flitch-engaging portion 116 extending from the actuating arm 112. The flitch-engaging portion 116 is configured to conform to the depth profile 108 of the dado holes 102 and includes a plurality of circular flitch-engaging knife edges 118 configured to run parallel to the depth profile 108 of the dado hole 102. In an alternative embodiment, dogs 122 include straight knife edges 124, as shown in FIGS. 11*a*-11*b*, configured to run parallel to the veneer-producing surface 120 of the flitch. Of course, if the selected dado holes 102 include a flat depth profile, the dogs can include a rectangular flitch-engaging portion to conform to the flat depth profile.

Figure 10:
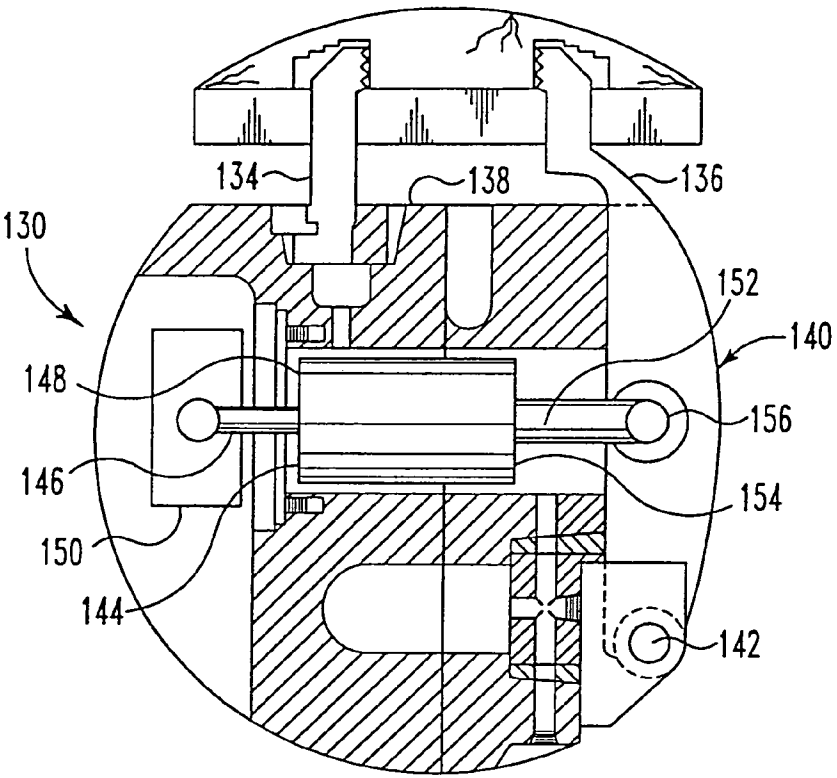
FIG. 10 illustrates the dogs of FIGS. 9*a*-9*b* installed on a conventional staylog.

Dogs 110, 122 can be coupled to a conventional staylog 130, as illustratively shown in FIG. 10. The dogs 110, 122 are mounted to the staylog 130 to form stationary dogs 134 and movable dogs 136 which are movable toward and away from the stationary dogs 150 to move the flitch 13 into engagement with the stationary dogs 134. The stationary dogs 134 extend from the staylog mounting surface 138 and the movable dogs 136 are formed on one end of a pivotable lever arm 140. The lever arm 140 pivots about pivot pin 142 in response to actuation of a conventional hydraulic (or pneumatic) piston-cylinder 144.

The piston-cylinder 144 can be a self-contained unit installed in the staylog 130, as illustrated in FIG. 10. The piston-cylinder 144 includes a connecting rod 146 coupled to a trunion block 150 fitted into the staylog 130 and a first end 148 of the cylinder 144. A piston rod 152 extends from a second end 154 of the cylinder 144 to a connecting pin 156 formed in the lever arm 140.

The dogs 110 are longer than the conventional dogs of a conventional staylog, and the depths of the holes 102 and the lengths of the dogs 110 are selected so the narrowest portion of the flitch 13 would be positioned farthest from the staylog mounting surface 104, due to the taper of the log, to retain the outermost surface of the flitch and its veneer producing portion substantially parallel to a slicing knife as previously described with reference to the embodiments of FIGS. 1-7.

An important feature of the present invention is the use of individual holes bored into the flitch mounting surface to accept flitch-retaining dogs, with the holes being separated from each other by areas of solid wood. It is the areas of solid wood between the holes that strengthen the edges of the flitch to eliminate flexing of the flitch edge under pressure from the knife. Eliminating flexing at the flitch edge allows a slicer to remove uniformly more of the best veneer from the edges without the problem of nonuniform and unacceptable veneer that arises in conventional flitch-retaining methods and apparatus.

The description that follows relates to the invention as it may be incorporated into a reciprocating veneer slicer. A reciprocating veneer slicer 200 is illustrated in FIGS. 12-17 and 20-21. Pin dogs 220 for use with the flitch table are illustrated in FIGS. 18-19.

Figure 12:
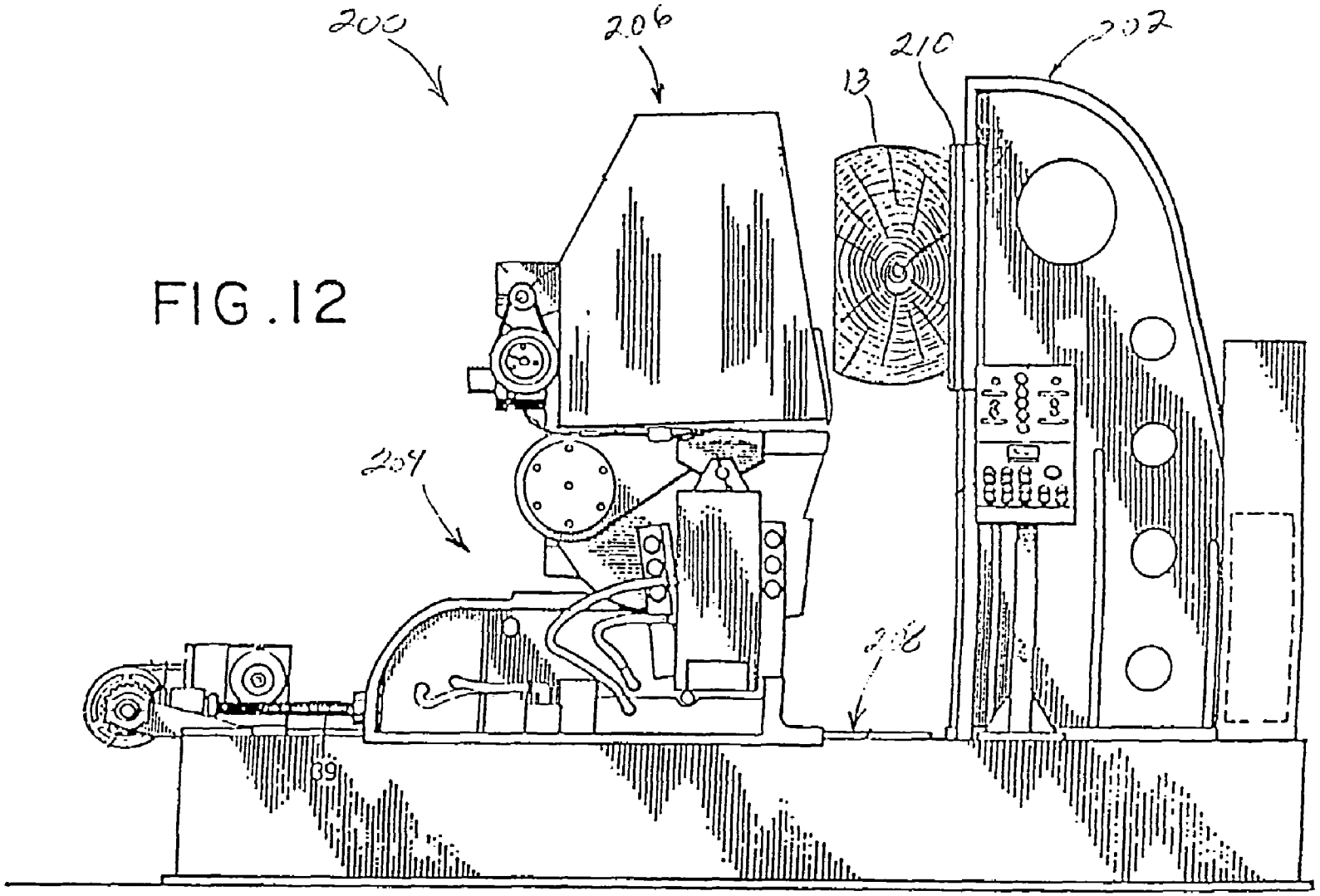
FIG. 12 is a side view of an illustrative reciprocating veneer slicer.

As illustrated in FIG. 12, a reciprocating veneer slicer 200 includes a flitch support assembly 202, a carriage 204, and a pressure plate and cutting blade assembly 206 coupled to the carriage 204. The carriage 204 reciprocates in a horizontal plane relative to the flitch support assembly 202 on a frame 208 that supports the veneer-slicing machine 200.

Figure 13:
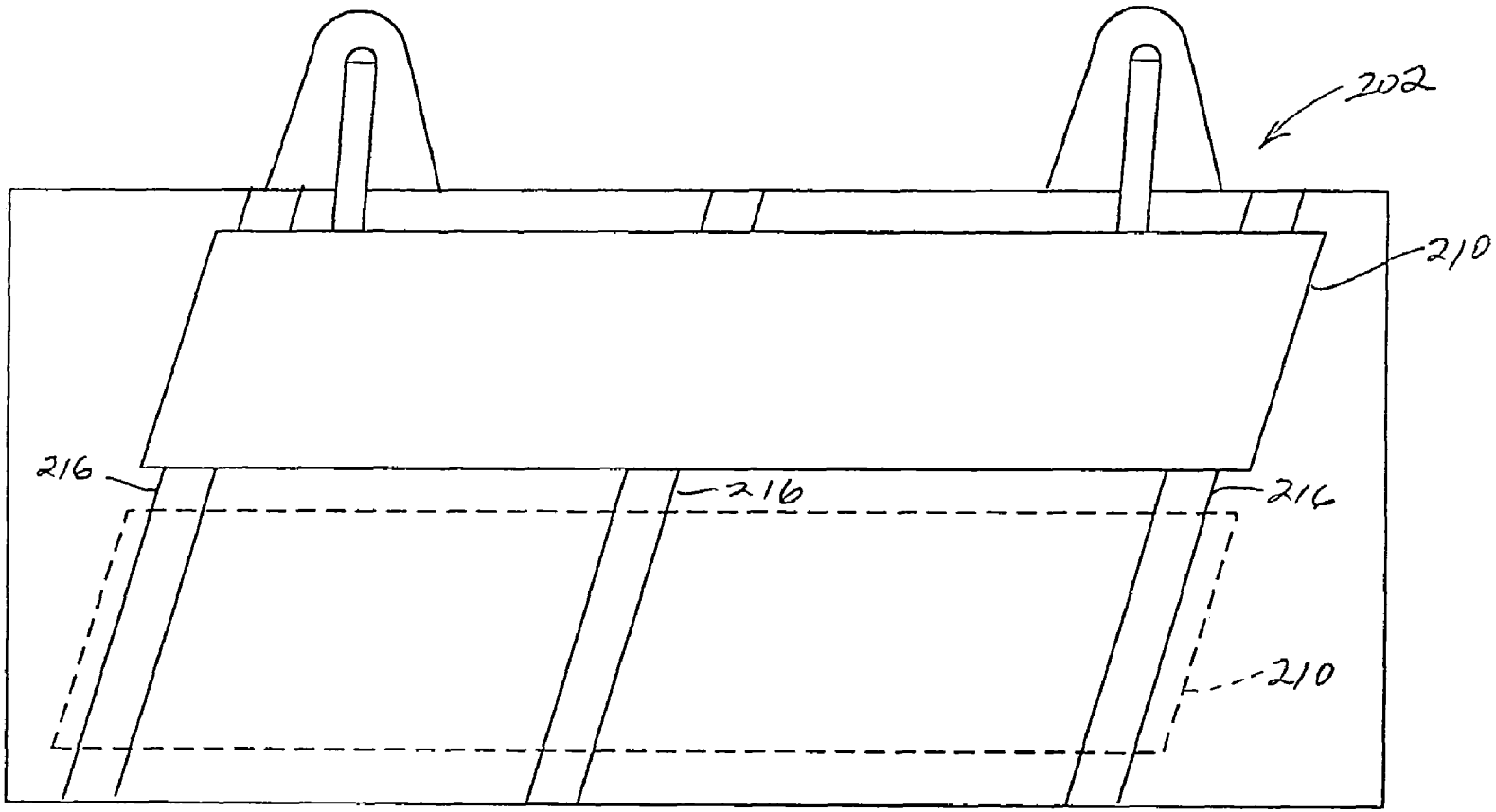
FIG. 13 is a front view of a flitch table and supporting structure illustrating a typical range and direction of motion of the flitch table.
Figures 14, 15:
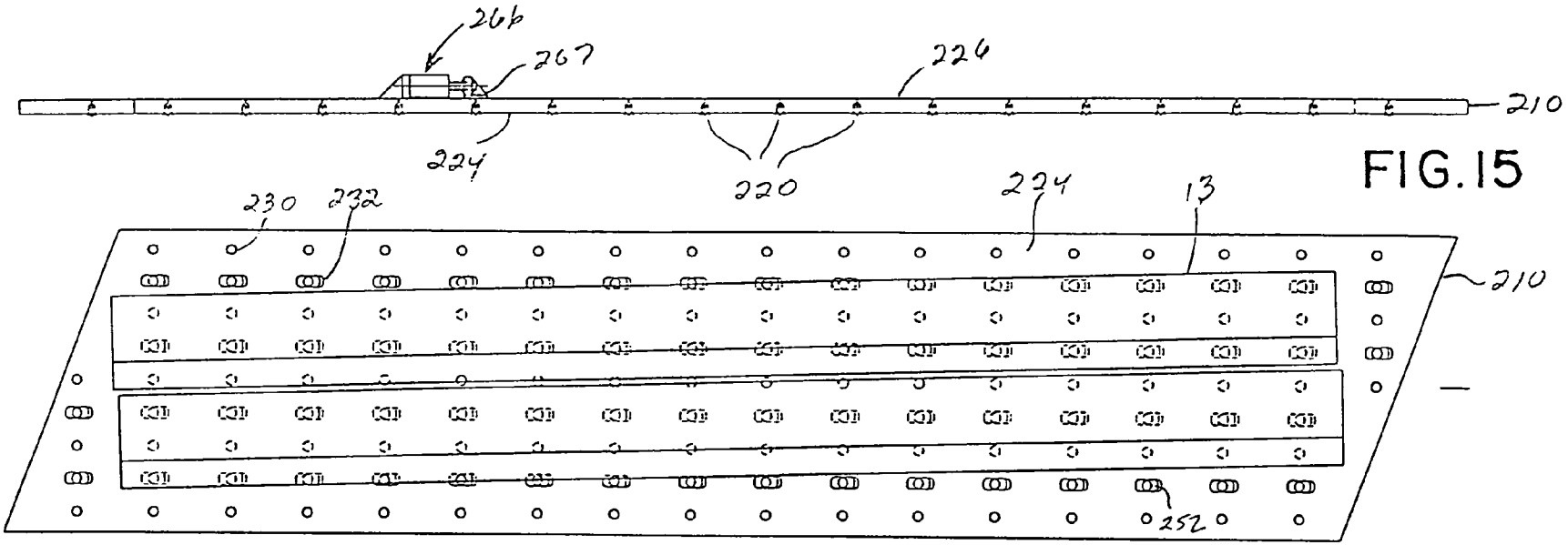
FIG. 14 illustrates a reciprocating flitch table having a pair of quarter flitches mounted thereon.
FIG. 15 is a top view of the flitch table of FIG. 14 showing a row of pin dogs in phantom.

As illustrated in FIG. 13, the flitch support assembly 202 includes a flitch table 210 that is coupled to a plurality of guide rails 216 that allow the flitch table 210 to reciprocate in a vertical plane relative to the carriage 204 between an upper position (shown in solid lines) and a lower position (shown in phantom). The flitch 13 is carried on the flitch table 210 and retained thereon by a plurality of dogs 220 (FIGS. 14-17).

Figure 16:
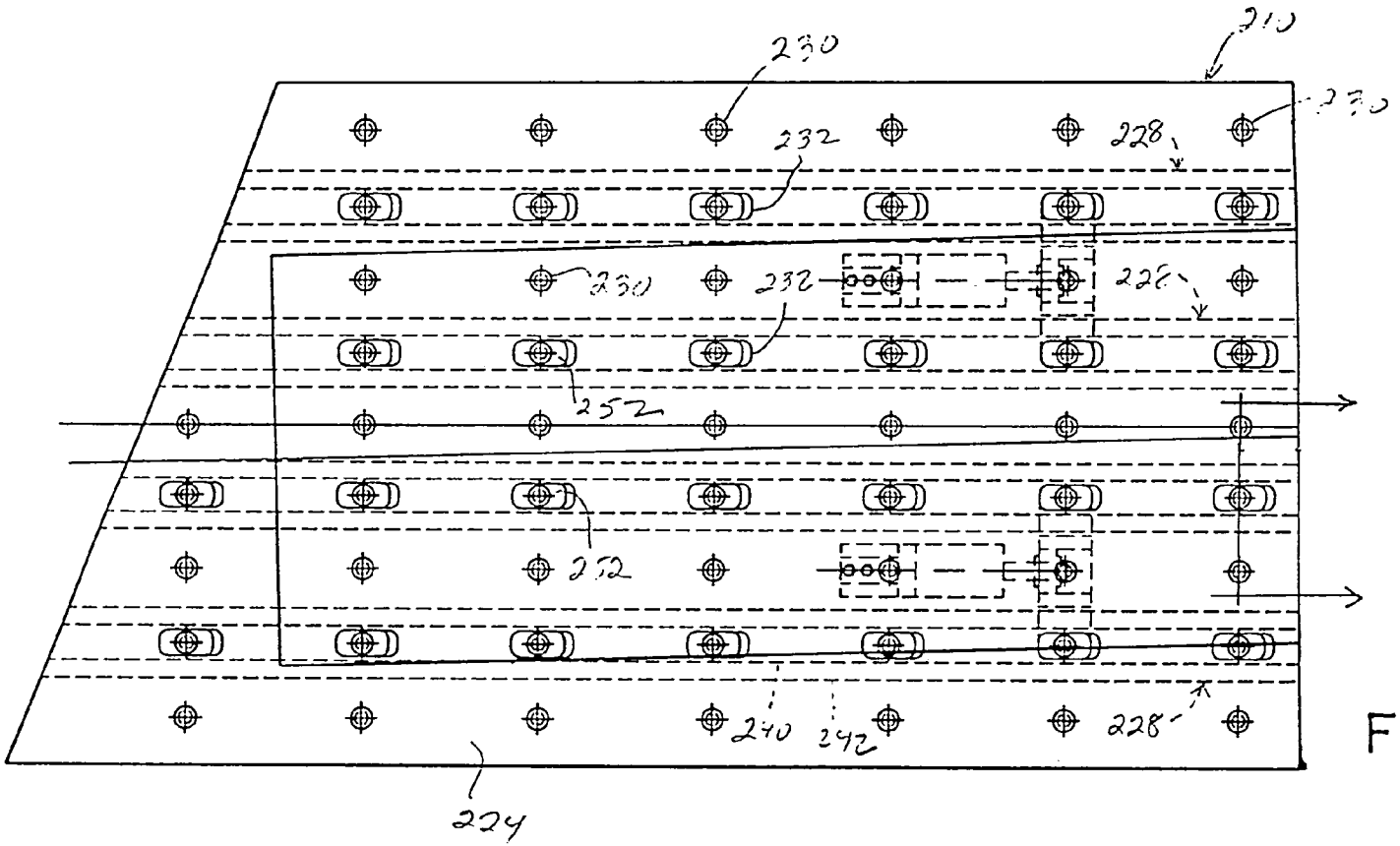
FIG. 16 is an enlarged view of one end of the flitch table of FIG. 14 having a single flitch mounted thereon.
Figure 17:
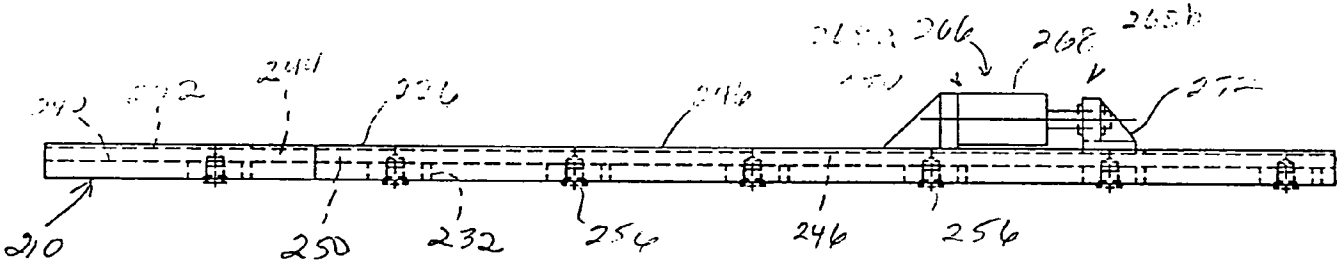
FIG. 17 is a top view of the end of the flitch table of FIG. 16 showing a pusher bar and pusher pins in phantom.
Figure 20:
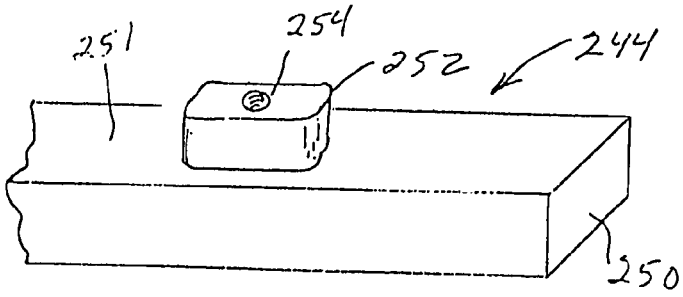
FIG. 20 is a perspective view of a portion of a pusher bar for use with the flitch table of FIGS. 16-17.
Figure 21:
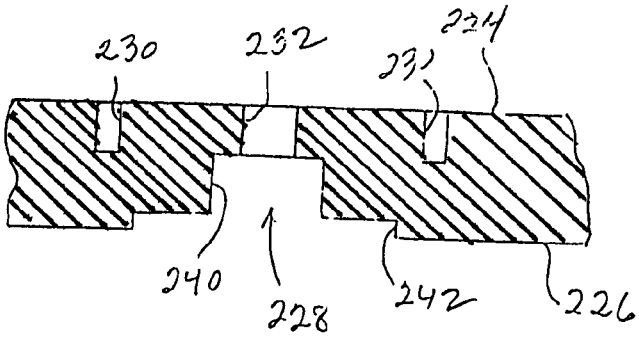
FIG. 21 is a partial section view of the flitch table of FIGS. 16-17 illustrating the pusher bar channel.

Referring to FIGS. 14-17, the reciprocating flitch table 210 includes a flitch mounting surface 224, and a rear surface 226. As best seen in FIGS. 16-17, a plurality of pusher bar-receiving channels 228 are formed in the rear surface 226, and a plurality of pin dog-receiving apertures 230 and a plurality of elongated pusher pin receiving slots 232 are formed in the mounting surface 224. The pin dog-receiving apertures 230 and the pusher pin-receiving slots 232 are arranged in a plurality of spaced-apart parallel rows, with the pusher pin-receiving slots 232 being arranged along the longitudinal axis of the pusher bar-receiving channels 228 and extending orthogonally through the flitch table 210 from the mounting surface 224 to the pusher bar-receiving channels 228, as best seen in FIGS. 17 and 21.

The pusher bar-receiving channels 228 include first and second channel portions 240, 242. The first channel portion 240 is configured to receive a pusher bar 244 (FIG. 20) and the second channel portion 242 is configured to receive a cover plate 246. The cover plate 246 keeps the first channel 240 free of debris and retains the pusher bar 244 in the first channel 240.

The pusher bar 244 (FIG. 20) includes a bar 250 having a generally rectangular cross section and a plurality of pusher pin segments 252 extending from a top surface 25 of the bar 250. The pusher pin segments 252 include apertures 254 for receiving pusher pins 256. The pusher pin receiving slots 232 formed in the mounting surface 224 are sized and configured to operatively receive the pusher pin segments 252 and permit axial movement of the pusher pin segments 252 therein.

Preferred embodiments of the invention include, as shown in FIG. 17, driving means 266 coupled to the rear surface 226 of the flitch table 210 and to adjacent pusher bars 244. Driving means 266 includes a piston and cylinder assembly 268 and a mounting bracket 270 for attaching a first end 268*a* of the assembly 268 to the rear surface 266. A U-shaped bracket 272 is attached to a second end 268*b* of assembly 268 and to adjacent bars 250 (FIG. 20) so that actuation of the piston and cylinder assembly 268 moves the pusher bars 244 in unison. It will be appreciated that a separate assembly 268 can be provided to drive each pusher bar 244. However, moving multiple pusher bars 244 together advantageously reduces the complexity and cost of the apparatus and improves maintainability.

Pin dogs 220*a*, 220*b* are shown in FIGS. 18-19. Preferred embodiments of the pin dogs 220 are substantially similar to the pin dogs 54 previously described, but eliminate the central polygon-shaped portion 72 (FIG. 6) and replace it with a tool-receiving aperture 260 formed in the top surface 262 of the pin dog 220*a*, 220*b*. Elimination of the polygon-shaped portion allows shorter pin dogs 220*b* to be used, as shown in FIGS. 19*b* and 24, which reduces the thickness of the backing board. However, it will be appreciated that the trade-off for a thinner backing board is the reduced ability to deal with flitch taper. Accordingly, preferred usage for the shorter pin dogs 220*b* will generally be limited to use with untapered flitches. The taller pin dogs 220*a* will be better able to position a tapered flitch on the flitch table 210 with the veneer-producing zone parallel to the veneer-slicing knife.

A tapered flitch 13 can be prepared in a fashion substantially similar to that described with reference to the rotating staylog. Pin dog receiving holes 90 and pusher pin receiving holes 92 can be bored into the flitch mounting surface 17 to a predetermined depth to define a veneer-producing zone 21. The tapered flitch 13 is mounted on the pin dogs 220*a* and pusher pins 256, as shown in FIG. 23, so that its outermost surface and veneer-producing zone 21 are oriented parallel to the veneer-slicing knife and the flitch mounting surface 17 is oriented at an acute angle to the table mounting surface 224. Of course, mounting the tapered flitch 13 to orient the veneer-producing zone 21 parallel to the veneer-slicing knife requires that the pin dogs 220*a* are taller than conventional dogs in order to accommodate the taper of the flitch 13. Accordingly, the pin dog-receiving holes 90 and pusher pin-receiving holes 92 have varying depth along the length of the flitch 13 depending on the amount of taper.

When the tapered flitch 13 has been mounted on the pin dogs 220*a* and pusher pins 256, an operator actuates driving means 266 to move the pusher bar 244 to push the flitch 13 into engagement with the pin dogs 220. The driving means 266 operates in substantially the same fashion as previously described with respect to the rotating staylog. Although this preferred embodiment of the invention uses pusher pins to move the flitch into engagement with the pin dogs, other means can be provided to engage and move the flitch into engagement with pin dogs, such as bars and/or brackets for engaging the ends of the flitch for its movement.

Untapered flitches can also be sliced in the reciprocating flitch table 210. Generally, the taper is removed from the flitch at the sawmill by squaring the log prior to cutting the log in half to form a pair of untapered flitches. The surface of the cut provides a flitch mounting surface 17 which is positioned adjacent the table mounting surface 224. Since the flitch is untapered, all of the pin dog-receiving holes 90 are bored to the same depth and the shorter pin dogs 220*b* can be used.

Typically, the depth of the pin dog-receiving holes 90 is substantially the same as the height of the pin dog 220*b* so that the flitch 13 rests against the top of the dog 220*b* and the flitch mounting surface 17 rests against the table mounting surface 224, as illustrated in FIG. 24, to provide maximum support to the flitch 13 during slicing. Of course, if less support is needed, based on the type of wood being sliced or other considerations, the taller pin dogs 220*a* can be used, which would provide increased versatility.

One problem encountered with the use of conventional reciprocating flitch tables is the thickness of the remaining backing board. Since conventional dogs typically extend about ⅝ inches from the mounting surface of the flitch table, the backing board is necessarily slightly thicker than that to eliminate contact between the knife and the dogs. Thus, a substantial thickness of the heart of the flitch is unavailable for slicing. To improve productivity, vacuum flitch tables have been developed to reduce the thickness of the backing board to about ⅜ inch by eliminating dogs and relying on vacuum to retain the flitch. Unfortunately, vacuum flitch tables have tended to require relatively high levels of maintenance due, at least in part, to contamination of the vacuum valves. Another problem with vacuum flitch tables has been lack of support for the flitch, allowing the flitch to flex in certain locations under pressure from the slicing knife. This flexing, which typically occurs at the site of the vacuum cells as the backing board gets thinner, renders the last sheets of veneer useless and places a practical limit on the amount of veneer that can be removed from the flitch using such vacuum tables.

The present invention overcomes the flexing problem associated with vacuum flitch tables. In particular, all of the pin dogs, as well as the pusher pins, can be short pin dogs 220*b*. The short pin dogs 220*b* can be designed to extend orthogonally from the mounting surface 224 about 3/16 inch and the pin dog-receiving holes bored to substantially the same depth. The number and placement of the dogs 220*b* on the flitch table 210, coupled with the annular knife edges, provides sufficient holding power to retain the flitch 13 on the table. At the same time, the depth of the holes formed in the flitch 13 to receive the dogs 220*b* can be set to allow the flitch 13 to rest against the mounting surface 224, which provides additional support to eliminate flexing under pressure from the knife. Thus, the dogs 220*b*, used in conjunction with the flitch table 210, eliminate the problems of conventional vacuum tables while allowing removal of maximum veneer from the flitch.

Another advantage of the dogging system of the present invention is that it eliminates bowing of the backing board due to hydraulic pressure applied by the pinching action of conventional dogs. In conventional flitch tables, the dogs move toward each other across the grain to pinch the flitch therebetween. As the backing board gets thinner, the force applied by the dogs tends to bow the backing board. Of course, no more useful veneer can be sliced from the flitch once the backing board begins to bow. In the present invention, the increased number of dogs 220, the annular knife edges engaging the flitch 13 along, instead of across, the grain, and the longitudinal movement of the flitch to engage the dogs 220, tend to eliminate bowing of the backing board.

Veneer mills are always looking for methods and apparatus for enhancing productivity. One effort to improve productivity included adding a direct feed veneer dryer to a veneer slicer. That is, as the veneer slicer was removed the veneer, the direct feed apparatus automatically fed the veneer to a dryer. Unfortunately, mills had great difficulty maintaining consistent results due to variations in the temperature and humidity of the atmosphere within the dryer. The primary reason for the inconsistency was due to the irregularity in the amount of veneer that was fed to the dryer over time.

In particular, as a flitch is being sliced, the veneer sheets are fed directly to the dryer. As the veneer passes through the dryer, each sheet affects the temperature and humidity in the dryer. As long as the veneer is fed into the dryer at a steady rate, the dryer can be adjusted to provide optimum results. However, when all of the veneer has been removed from the flitch, the backing board has to be removed from the slicer and replaced by a new flitch. During the changeover process, the dryer is idle and the temperature and humidity change. When the veneer from the next flitch begins to pass through the dryer, the temperature and humidity fluctuates again until a steady-state can be achieved. Unfortunately, those sheets that pass through the dryer while the atmospheric conditions are fluctuating have less than ideal quality. Fans and vents have been added to compensate for the changes in conditions due to changeover, but the results have not been satisfactory. It is believed that a short changeover time, on the order of about one minute, will not adversely affect the atmospheric conditions in the dryer, but until the present invention, it has not been possible to changeover a flitch in that amount of time on a consistent basis over the course of an entire work day.

Figure 22:
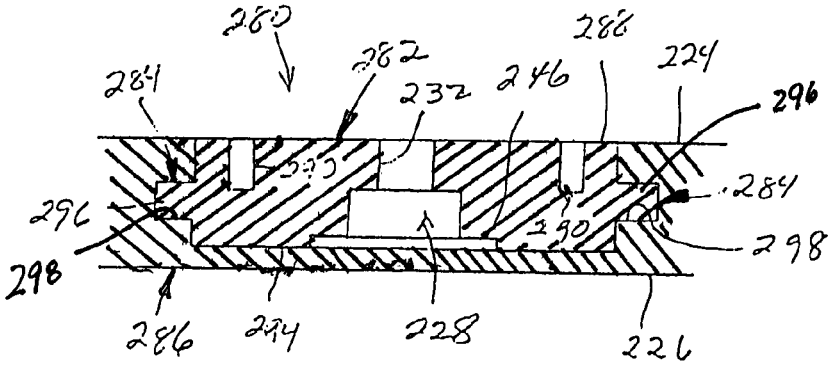
FIG. 22 is a partial cross-sectional view taken transversely of a flitch table of FIGS. 16-17 for illustrating a modular assembly for holding a flitch and its engagement with the flitch table.

The present invention, as illustrated in FIG. 22, overcomes the changeover problem by modularizing the flitch retaining apparatus. In particular, a modular assembly 280 includes a table segment 282, shown in cross-section, and a flitch table 286, also shown in cross-section, and means 284 for coupling the table segment 282 to the flitch table 286. The means 284 for coupling the table segment 282 to the flitch table 286 comprises a tongue and groove arrangement, which includes tongues 296 formed on the sides of the table segment 282 and a grooves 298 formed in the inside surfaces of the flitch table 286 to receive the tongues 296 of the table segment 282, as shown in FIG. 22. The resulting modular assembly 280 includes a mounting surface 288, formed to include pin dog-receiving apertures 290 and pusher pin receiving slots 232, and a back surface 294 formed to include a pusher bar-receiving channel 228.

As shown in FIG. 22, the means 284 for coupling the table segment 282 to the table 286 includes tongues 296 formed on the table segment 282 and complementary grooves 298 sized and configured to receive the tongues 296. The tongue and groove arrangement permits easy installation and removal of the modular assembly 280. In changeover, the table segment 282 is positioned so that its tongues 296 can enter and slide into the grooves 298 formed in flitch table 286, thus coupling the table segment 282 to the flitch table 286. Although a tongue and groove arrangement is shown, it will be appreciated that other mechanisms, such as fasteners and retainers, can be used to couple the modular assembly to the table.

In operation, the modular assembly 280 is positioned at a remote location where a flitch is mounted on the assembly 280 in a fashion substantially similar to that previously described. When the flitch is mounted, the assembly 280, with the mounted flitch, is installed in the table 286 by aligning the tongue 296 with the groove 298 and sliding the assembly 280 into position on the table 286. The modular assembly 280 can be retained on the flitch table 286 by friction fit between the tongue 296 and groove 298 or by retaining pins (not shown) or any suitable fastening or retaining mechanism. When the assembly 286 is positioned, the flitch is sliced in a conventional manner. As the flitch is being sliced, however, a second flitch is simultaneously being mounted on a second modular assembly 280 so that the second flitch will be ready for slicing when all of the veneer has been sliced from the first flitch.

After the veneer has been removed from the first flitch, the first modular assembly 280 is removed from the flitch table 286 and moved to the remote location where the remainder of the flitch (the backing board) is removed and a third flitch is mounted on the modular assembly 280. As soon as the first modular assembly is clear of the flitch table 286, the second modular assembly 280, with the mounted flitch can be installed. Thus, while the first modular assembly 280 is being reloaded with a new flitch, the second flitch is being sliced. By using two or more modular assemblies 280, a veneer mill can minimize the amount of time needed to mount a new flitch on the flitch table 286 and thereby maximize the productivity of its slicers. If the mill has a direct feed dryer, the minimized reload time improves the performance of the dryer, thereby improving the quality of the finished veneer.

Although the modular assembly 280 has been disclosed in relation to a reciprocating flitch table, it will be appreciated by those of ordinary skill in the art that the modular assembly is equally effective when used with a rotary staylog. For example, the modular assembly 280 can include a pair of grooves or a plurality of pockets in place of the tongues 296. The grooves or pockets can be positioned along the sides of the modular assembly 280 to be engaged by conventional dogs and thereby be retained on the staylog.

Although the invention has been described in detail with reference to certain preferred embodiments, variations and modifications exist within the scope and spirit of the invention as described and defined in the following claims.

The invention claimed is:

1. A method of retaining a flitch on a flitch table for cutting veneer from the flitch, the flitch table having a plurality of pin dogs, the method comprising the steps of:

providing a flitch having a first plurality of holes for receiving the plurality of pin dogs, the peripheries of said holes forming a plurality of engagement surfaces;

positioning the pin dogs in the first plurality of holes; and moving the flitch and the plurality of pin dogs into engagement to retain the flitch on the flitch table.

2. The method of claim 1 further comprising providing a second plurality of holes in the flitch, and providing a plurality of pusher pins, said second plurality of holes being positioned for receiving the plurality of pusher pins.

3. The method of claim 2 wherein the moving step further includes the step of providing means for moving the pusher pins to move the flitch along a longitudinal axis of the flitch into engagement with the stationary dogs.

4. The method of claim 1 further including the step of providing a modular assembly for positioning the plurality of pin dogs and for moving the flitch into engagement with the dogs to mount the flitch on the modular assembly, the modular assembly being removably received by the flitch table.

5. The method of claim 4 wherein the flitch table includes means for retaining the modular assembly in position for slicing veneer from the flitch mounted on the modular assembly.

6. A method for retaining a tapered flitch for cutting veneer from its tapered outer surface comprising:

providing a staylog with a plurality of dogs;

providing the flitch with a plurality of holes positioned to receive the plurality of dogs;

providing relative motion between the plurality of dogs and the plurality of holes; and engaging the plurality of dogs with the flitch to retain the flitch in the staylog for cutting.

7. The method of claim 6 wherein the plurality of dogs have projecting surfaces and their relative movement with respect to the flitch engages the flitch.

8. The method of claim 7 wherein the flitch is moved for engagement with the plurality of dogs.

9. The method of claim 7 wherein the flitch is moved longitudinally along its central axis.

10. The method of claim 7 wherein the staylog is provided with a further plurality of dogs, and the flitch is provided with a further plurality of holes positioned to receive the further plurality of dogs, and the further plurality of dogs are moved to engage the flitch and the first plurality of dogs.

11. A method for cutting veneer sheets from a tapered flitch, comprising the steps of:

providing a staylog for a veneer slicing machine having a veneer slicing knife;

attaching a flitch having a tapered veneer producing face to the staylog with the tapered veneer producing face affixed in a stable, parallel relationship with the veneer slicing knife; and cutting veneer sheets with the veneer slicing knife from the tapered veneer producing face of the flitch.

* * * * *